United States Patent [19]

Fish

[11] 4,442,781

[45] Apr. 17, 1984

[54] DEPOSIT BOX

[75] Inventor: Leonard A. Fish, Chicago, Ill.

[73] Assignee: Avco Corporation, Huntsville, Ala.

[21] Appl. No.: 966,583

[22] Filed: Dec. 5, 1978

[51] Int. Cl.[3] ..... E05G 1/026

[52] U.S. Cl. ..... 109/53; 109/24.1

[58] Field of Search ..... 109/24.1, 53, 54, 55, 109/57, 59 R, 64, 66; 232/43.2; 346/22

[56] References Cited

U.S. PATENT DOCUMENTS 2,770,516 11/1956 Mestre ..... 109/24.1

2,923,587 2/1960 Zipf ..... 109/24.1 X

*Primary Examiner*—David H. Corbin

*Attorney, Agent, or Firm*—Irwin P. Garfinkle; Charles M. Hogan; Robert J. McNair, Jr.

[57] ABSTRACT

A deposit box for an automatic teller machine equipped with a deposit receiving chamber and an auxiliary or escrow chamber, both of which are provided with access doors communicating with the exterior of the box. Both doors are opened and closed automatically, by inserting and removing the box from the automatic teller machine. An internal door, communicating between the two chambers is provided, and the cover of the box is prevented from assuming a fully seated position unless the internal door is closed.

2 Claims, 3 Drawing Figures

DEPOSIT BOX

BACKGROUND OF THE INVENTION

1. Field of the Invention

The present invention relates to a deposit box for use with an automatic teller machine, and more particularly to a deposit box which is suitable for use with an automatic teller machine located at an outside the bank location such as a shopping center or the like.

2. Prior Art

In recent years, a variety of automatic teller machines have been designed, and nearly all of them have some facility for receiving deposits or the like. When money dispensing is a feature of the machine, some provision must be made for safeguarding money which is dispensed but which is not withdrawn by the user, from an access area. A container for such money must also be secured, and separate from deposited items. Especially when automatic teller machines are designed for locations not within banking premises, for example transportation stations, shopping centers and the like, it has been necessary to ensure that the deposit boxes of the machines are handled always by two individuals, so that a double check system may be employed, to guard against any theft of deposits or the like. The requirement for two people to handle deposit boxes, for the previously designed machines, represents a relatively great obstacle to their widespread use, especially in out-of-bank locations. It is therefore desirable to provide a deposit box which may be received in an automatic teller machine in such a way that it is useable to receive deposits and other items, during the use of the automatic teller machine, keeping such items separate and automatically locking the box when it is withdrawn from the machine in such a way that the compartments are secure and safe.

BRIEF DESCRIPTION OF THE INVENTION

It is a principal object of the invention to provide a deposit box having means for opening a deposit receiving door and an escrow receiving door when the box is placed in position in an automatic teller machine, but automatically closing and locking such doors when the deposit box is withdrawn from the teller machine.

Another object of the present invention is to provide a deposit box having an escrow compartment for receiving materials other than conventional deposits, with means for allowing access to the escrow compartment while the deposit box is in position within the automatic teller machine, but automatically closing and locking the opening into the escrow compartment when the deposit box is removed from the machine.

A further object of the present invention is to provide a removable lid for a deposit box, for allowing easy access to the interior of the deposit box when the lid is removed, with key-operated means for locking the lid in position, and for cocking the doors of such box for automatic locking.

A further object of the present invention is to provide a deposit box having a deposit receiving chamber and an escrow compartment, an access door located within the interior of the deposit box separating the escrow compartment from the deposit receiving chamber, and means for ensuring that the internal escrow chamber access door is in position separating the escrow compartment from the deposit receiving chamber when the deposit box is in its locked position.

These and other objects and advantages of the invention will become manifest by an inspection of the following description of the accompanying drawings.

In one embodiment of the present invention there is provided a deposit box having a deposit-receiving chamber adapted to be closed with a removable cover, means for locking the cover in position on the deposit box, a selectively openable deposit receiving door, means for unlocking the selectively openable deposit receiving door so that it may be opened once and then closed, after which the deposit receiving door remains locked shut, and means responsive to insertion of the deposit box in a position in an automatic teller machine for automatically opening the deposit receiving door, the deposit receiving door being shut and locked when a deposit box is removed from the automatic teller machine.

In another embodiment of the present invention, there is provided a deposit box having an escrow chamber with an access door separating the deposit receiving chamber from the escrow chamber, with means for preventing the correct positioning of the cover on the deposit box unless the internal escrow access door has first been moved to its closed position. Means is also provided for automatically opening the entrance door to the escrow chamber at the same time that the deposit-receiving door is opened, when the deposit box is placed in position within an automatic teller machine.

BRIEF DESCRIPTION OF THE DRAWINGS

Reference will not be made to the accompanying drawings in which.

DESCRIPTION OF THE PREFERRED EMBODIMENTS

Figure 1:
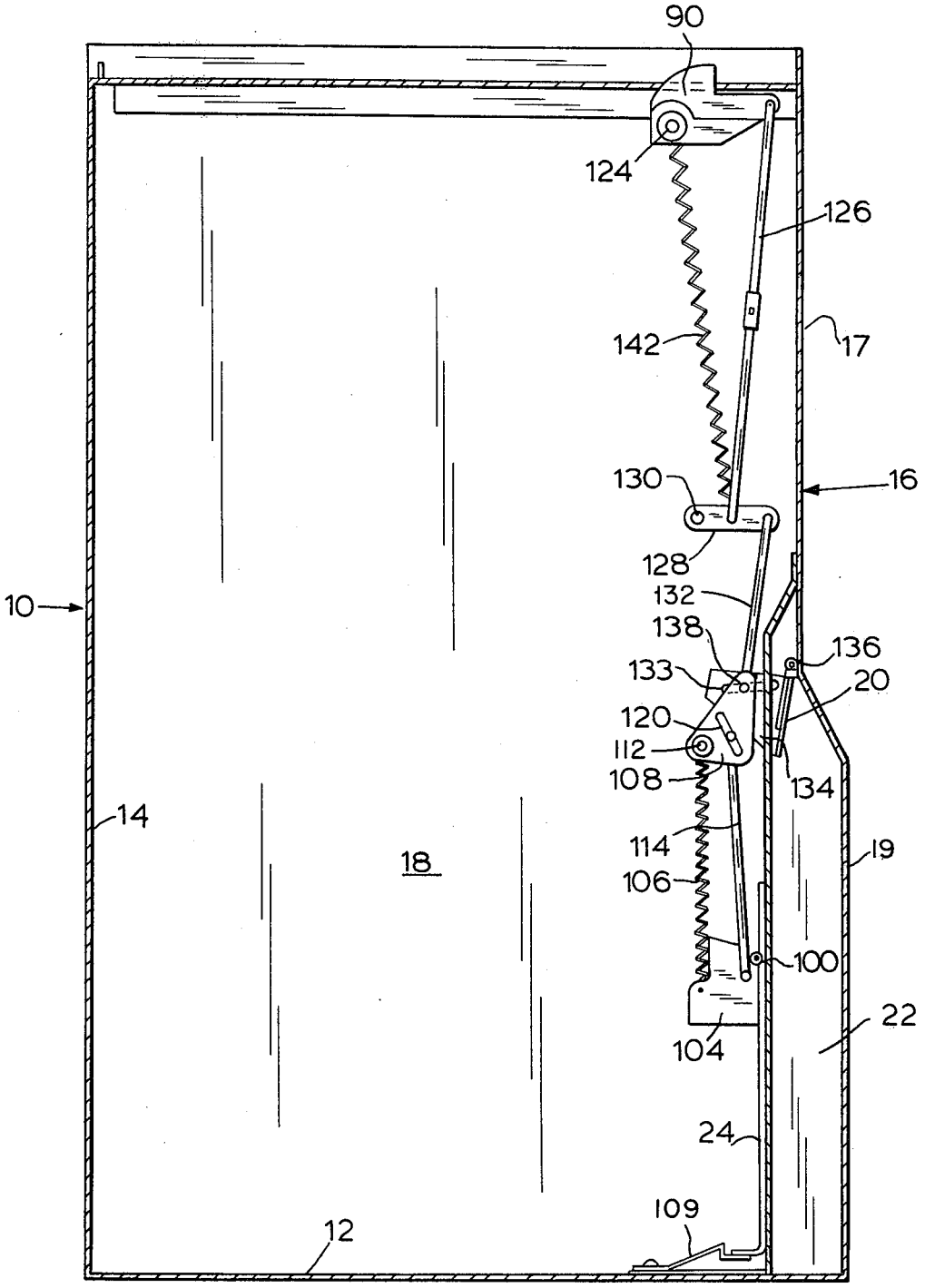
FIG. 1 is a vertical cross sectional view of a deposit box incorporating an illustrative embodiment of the present invention.

Referring now to the drawings, a vertical cross sectional view of a deposit box incorporating the present invention is illustrated in FIG. 1. The box 10 is formed generally of sheet metal, and is completely enclosed with a bottom wall 12, a rear wall 14, a front wall 16, and two side walls 18. The front wall 16 has an upper portion 17 and an extended lower portion 19, the upper and lower portions being interconnected by an escrow entrance door 20, the construction and operation of which is described in more detail hereafter. The various walls, and the door 20, completely enclose the deposit box and define an interior chamber therein, most of which is referred to as the deposit receiving chamber. A relatively small chamber directly below the escrow entrance door 20 will be referred to the escrow compartment 22. The escrow compartment is separated from the deposit receiving compartment by an escrow access door 24.

The rear wall 14 is somewhat lower in height than the side walls 18 and the front wall 16, to allow a cover to be slid into position over the deposit receiving chamber. The cover (FIG. 2) is formed principally of a piece of sheet metal 26, and is provided with a conventional key lock 25 having a lock tab 30 adapted to engage an abutment (not shown) on one of the side walls 18, to prevent removal or withdrawl of the lid from closed position when the lock is in its locked position as illustrated in FIG. 2.

When the cover is in closed position over the deposit box, the upper extremity of the box is completely sealed except for a deposit receiving door which may be selectively opened. A sliding gate member 32 is pivotably supported on the bottom surface of the sheet 26, by a stud 34, and when the gate 32 is pivoted about the stud 34 in a counterclockwise direction, a rectangular tab portion 36 of the gate is withdrawn from a rectangular opening in order to expose the deposit receiving door.

Figure 2:
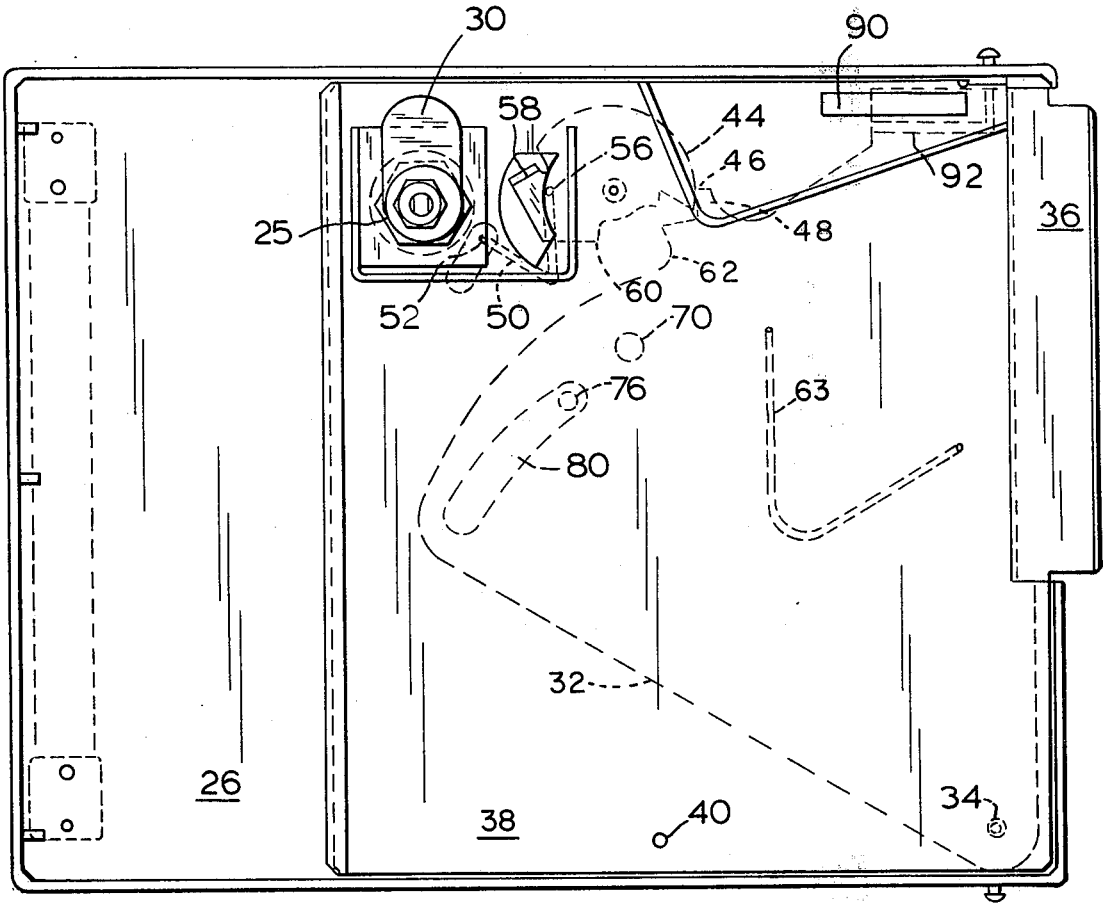
FIG. 2 is a plan view of a selectively lockable cover for the deposit box of FIG. 1, seen from its underside.

The cover as illustrated in FIG. 2 is seen from its bottom side, and it is apparent from this figure that when the swinging or sliding gate 32 is rotated in a counterclockwise direction, the rectangular opening appears, defined by a corner cut out portion of a plate 38 which overlies the underside of the sliding gate 32. The cover plate 38 is staked to the sheet 26 at a plurality of locations 40, one of which is shown, but is spaced from the sheet 26 sufficiently to allow the sliding gate 32 freely to rotate between the sheet 26 and the plate 38.

As illustrated in FIG. 2, the gate 32 is locked in its closed position by means of a gate locking cam 44 having a peaked projection 46, formed with a curved gate holding edge (as shown in FIG. 2) which engages the latched edge of formation 48 on the gate 32. The cam 44 is maintained in its clockwise rotated position, illustrated in FIG. 2, by a spring 50, one end of which is secured to a bracket 52 in fixed relationship to the cover 26 and the other end of which is received in an aperture 56 provided in the locking cam 44. The spring 50 urges the locking cam 44 in a clockwise direction as illustrated in FIG. 2, so that the projection 48 remains trapped or latched behind the projection 46.

In order to unlock the sliding gate 32, a key is inserted in the lock 28 and the tab 30 is rotated in clockwise direction, as viewed in FIG. 2, against the flange 58 of the gate locking cam 44. Rotation of the tab 30 against the flange 58 rotates the locking cam 44 in a counterclockwise direction, and the spring 50 assumes an overcenter position, tending to rotate the locking cam in a counterclockwise direction, thus bringing the rear edge 60 of a notch into engagement with the kick back edge 62 of a projection on the sliding gate 32. With the locking cam 44 rotated in a counterclockwise direction, the tab 48 is free of the tab 46, so that the gate 32 may be rotated in a counterclockwise direction to withdraw the gate 32 from over the deposit receiving entrance to the deposit chamber. The sliding gate 32 is maintained in its closed position, however, by the force of a spring 63, interconnected between the sliding gate 32 at one end and the cover plate 38 at its other end.

Figure 3:
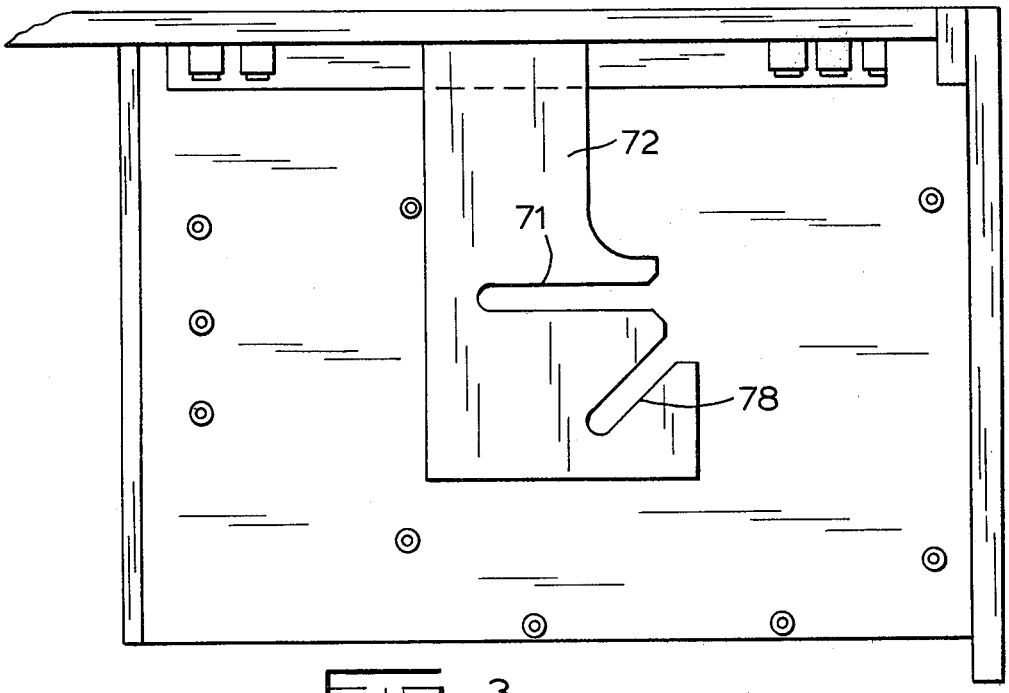
FIG. 3 is an-upside-down view of a cam plate adapted for automatically opening the deposit-receiving door and the escrow entrance door of the deposit box when it is inserted into an automatic teller machine, and for closing the same doors when it is withdrawn from the automatic teller machine.

When the deposit box is inserted into its proper position in the automatic teller machine, a first follower or pin 70, welded in fixed position to the upper sheet 26, engages or tracks the straight cam slot 71 of a cam member 72 illustrated in FIG. 3. The straight slot 71 permits the deposit box to be slid directly into position within the automatic teller machine in a linear fashion, while a second follower or pin 76 is received in an angled steering slot 78 of the cam member 72. It is apparent from FIG. 3, that as the deposit box is inserted into position, the pin 76 is cammed away from the pin 70. The pin 76 is fixed to the sliding gate 32, and extends through a curved slot 80 provided in the upper wall 26. As the pin 76 is urged away from pin 70, the sliding gate 32 is moved counterclockwise as illustrated in FIG. 2, and the envelope receiving entrance is exposed. Rotation of the sliding gate 32 causes the kick back edge 62 of the projection 48 to bear against the edge 60 of the notch formed in the locking cam, thereby rotating the locking cam in a clockwise direction, and causing it to assume the position illustrated in FIG. 2. Since the tab 48 is already behind or leftward of the tab 46, however, the access door remains open, so that the deposit box is free to receive deposit envelopes while it is in the automatic teller machine.

When the deposit box is withdrawn from the automatic teller machine, the angled cam slot 78 causes the pin 46 to move toward the pin 70, thereby rotating the sliding gate 32 clockwise as illustrated in FIG. 2 and closing the deposit receiving opening with the section 36 of the sliding gate 32. In reaching this position, the tab 48 passes by the tab 46, thereby momentarily rotating the locking cam 44 in a counterclockwise direction, but not sufficiently to cause the spring 50 to assume an overcenter position. Therefore, the locking cam 44 resumes its clockwise rotated position as soon as the tab 48 assumes the position illustrated in FIG. 2, so that the parts again become locked, and can be unlocked only by rotation of the locking tab 30 when a key is pushed in the lock 28. Accordingly, the envelope receiving opening is closed and locked automatically when the deposit box is withdrawn from its position in the automatic teller machine.

A portion 92 of the sliding gate 32 is adapted to engage a linkage control cam 90, the position of which is illustrated in dashed lines in FIG. 2. The cam 90 is illustrated in FIG. 1 in the first limit or counter-clockwise position it assumes when the cover is not in position on the deposit box. The function of the cam 90 is to ensure that the escrow access door 20 is open when the deposit box is in position within the automatic teller machine, and to prevent seating of the cover in proper position unless the escrow access door 24 is in its closed position.

The escrow access door 24 is pivoted on a shaft 100 which is mounted on a wall 102, supported by the interior of the wall 16 as illustrated in FIG. 1. The access door 24 has a bracket 104 secured thereto, and a spring 106 connected between the bracket 104 and a pivot member 108 urges the escrow access door 24 into its open or clockwise position. It is held in its closed or counterclockwise position, by being manually pushed forward until its bottom end is trapped behind a leaf spring latch 109 secured to the bottom wall 12 of the deposit box.

The pivot member 108 is pivoted to the side wall 18 on a shaft 112, and a wire link member 114 interconnects the bracket 104 with the pivot member 108. The link 114 is pivoted at one end in an aperture in the bracket 104, and its upper end is bent at a right angle and received in an arcuate slot 120 provided in the pivot member 108 so as to complete a safety interlock, articulated with linkage 112, 132, 134, 128, 130 and 126. When the escrow access door 24 is in its open position, the link 114 is raised relative to the pivoting shaft 100, and prevents the pivot member 108 from rotating in a clockwise direction. When the escrow access door 24 is in its closed position, as illustrated in FIG. 1, the position of the link 114 is relatively low, and the pivot member 108 may be rotated.

With the escrow access door closed, the cover may be slid into position over the top of the escrow receiving chamber. As the top engages the cam 90, the cam 90 rotates clockwise about a pivot shaft 124. The link 126 is connected to the cam 90 and is forced downwardly, rotating a bell crank 128 in a clockwise direction about pivot 130. This brings about the downward motion of a further link 132 which is attached to one end of the bell crank 128 at its upper end, and its lower end is pivotally received in a slot 133 in a bracket 134, which bracket is secured to the rear surface of the escrow entrance door 20. The downward movement of the link 132 causes the escrow access door to rotate counterclockwise about a pivot 136, into its closed position. The bottom end of the link 132 is also pivotally connected to the pivot member 108. The pivot member 108 rotates clockwise as the door 20 closes. When the door 20 is in its closed position, any external force applied to the door is passed by the bracket 134 and pivot member 108 to the shaft 112, and does not rotate the door.

The linkage-control cam 90 is held in its limit clockwise or depressed position to hold door 20 closed only as long as the sliding gate 32 is in the position illustrated in FIG. 2. When the deposit box is inserted into position in the automatic teller machine, and the sliding gate 32 is rotated, the cam 90 is free to rise to its upper or counter-clockwise limit position, which it does under the urging of a spring 142. This brings about a counterclockwise rotation of the bell crank 128, and the raising of the link 132, to open the entrance door 20 to the escrow compartment by pivoting about the shaft 136. When the deposit box is withdrawn from the automatic teller machine, the sliding gate is rotated back to a closed position, as described above, which again depresses the cam 90, and brings about the closing of the door 20, after which it is held in closed position by the links which have been described above. It may not again be open until the cam 90 is again permitted to rise to its upper position, which occurs when the cover is removed from the deposit box.

If there is an attempt made to place the cover in the position over the deposit box before the escrow access door has been closed, the link member 114 is in its raised position, keeping the pivot member 108 from rotating as required to shut the entrance door 20. This therefore prevents the required downward movement of the link 132, so that the cam 90 cannot be depressed. Accordingly, it is impossible to seat the cover in closed position until the escrow access door 24 has first been moved in the closed position.

It will be appreciated that the deposit box of the present invention is adapted to perform economically and efficiently the requirements of the deposit box of an automatic teller machine, being adapted to receive deposit envelopes and escrow deposits normally when in position within the automatic teller machine, but locking both of these openings closed as soon as the deposit box has been removed from the machine. When the deposit box is to be replaced in an automatic teller machine, the lock 25 may be moved to its unlocked position before it is inserted into position within the automatic teller machine. Since the deposit box is empty at this time, there is no loss of security. After the deposit box has been placed into an automatic teller machine and later removed, it is maintained in a locked condition until it is unlocked by means of a key in the lock 28. It is therefore not necessary, for security, to use two persons for the purpose of replacing deposit boxes in automatic teller machines. Since the box of the present invention, except when empty, is always locked when out of association with an automatic teller machine, there is no loss in security by its being handled only be one person at a time.

The feature of ensuring that the escrow access door is closed before the cover can be properly positioned, ensures that there will be no unintentional intermixing of the contents of the escrow compartment with the deposit receiving compartment.

It will be apparent that various modifications and improvements may be made in the invention of the present application without departing from the essential features of novelty thereof, which are intended to be defined and secured by the appended claims.

I claim as my invention:

1. The combination of a box, formed with a deposit chamber and an escrow-chamber, and a removable cover, said combination being adapted to be advanced into or retracted from an automatic teller, said removable cover comprising a top sheet, a swingable gate pivotally mounted under said sheet and adapted to swing to provide access to said deposit-chamber, said gate being formed to provide a deposit-chamber door, said gate being further formed with a depressing portion, a gate cam lock for holding said gate in closed position but operable to permit opening and closing of the deposit-chamber door, a key-operated cover lock operable to release said gate cam lock, and means sensitive to linear displacement of said cover relative to said automatic teller for opening or closing said deposit-chamber door, said box comprising a manually operable internal door between the chambers, an external door for the escrow chamber, means including a linkage-control cam and a linkage for opening and closing said external escrow-chamber door when said linkage-control cam moves to first and second limit positions, respectively, and safety interlock means responsive to said open position of said internal door for restraining said linkage to hold said linkage-control cam firmly in said first limit position to prevent the cover from assuming an assembled condition relative to said box, said cover normally fitting on said box and placing said depressing surface and control element in cooperative relationship as the cover moves toward the assembled condition with the box, thereby to permit both escrow-chamber door and deposit-chamber door to open and close together, unless said linkage-control cam is held firmly in said first limit position by reason of the manually operable internal door being open, in which case the interlock responds.

2. A box and removable cover combination adapted to be advanced or retracted in relation to an automatic teller of the type formed with a straight cam slot and a steering cam slot angularly diverging from the straight cam slot, said combination comprising a box unit, said box unit being formed with a deposit-receiving chamber and an escrow-receiving chamber, said box unit including a manually operable internal door swingably mounted between said chambers and providing internal access to said escrow-receiving chamber, a latch for releasably holding said internal door closed, an external escrow-chamber door, a linkage-control cam rotatably mounted adjacent the top of said box, said linkage-control cam being adapted to be engaged and moved clockwise as the cover moves to an assembled condition on the box unit, a linkage intercoupling the linkage-control element and the external escrow-chamber door in such manner that the external escrow-chamber door is opened when the linkage-control cam is displaced to a first or counter-clockwise limit position and closed when the linkage-control element is displaced to a second or clockwise limit position, said linkage including a spring which biases the control element to the first limit position, and interlock safety means intercoupling the linkage and the internal door, said interlock safety means including a link articulated at one end with said linkage and connected at the other end to said internal door so as to move with said internal door, said safety means being so constructed and arranged as to free said linkage if the internal door is in closed position but to restrain said linkage and hold said linkage-control cam in its first limit position when the internal door is in open position, whereby the cover is prevented from assuming an assembled condition relative to the box unit unless the manually operable internal door is closed, said removable cover normally moving toward assembled condition with the box unit and comprising a top sheet formed with an aperture and a first pin-like follower, said first pin-like follower being adapted to track the straight cam slot when the combination is advanced and retracted, a lower plate secured to be rigidly spaced from said top sheet and formed to provide an access opening between customer and deposit chamber, a gate mounted to swing between the sheet and slot, and a key-operated lock and a gate latch cam and means for yieldably urging said gate toward closed position, said gate lock cam normally closing said gate and being formed with latching and kick back edges and mounted to have two limit positions, at one of which it engages the closed gate and at the other of which it is kicked by the opening gate back to latching position, said key-operated lock being formed to hold the cover on the box and manually operable to unlatch said gate lock cam from the gate, said gate having a set of five formations, of which the first is a deposit-chamber door portion, the second is a latched edge held by the gate lock cam until unlatched, the third is a second pin-like follower which projects through an aperture in the top sheet to track the steering cam slot and to swing the gate and deposit-chamber door open when the combination is advanced, the fourth is a kick back edge which kicks the gate latch cam back to latching position as the gate opens so that the gate is again latched after one opening and closing, and the fifth is a portion which depresses the linkage-control cam when the gate is in closed position but frees the linkage-control cam as the gate is opened to assure that the gate with its deposit-chamber door and the escrow-chamber door open together, the last-mentioned two doors closing together as the combination is retracted, the second follower swinging the gate to closed position and the fifth formation on the gate again depressing the linkage-control cam.

* * * * *